US008973540B2

(12) United States Patent
Kim et al.

(10) Patent No.: US 8,973,540 B2
(45) Date of Patent: Mar. 10, 2015

(54) VARIABLE VALVE SYSTEM

(75) Inventors: Jungho Kim, Yongin-si (KR); Gi Ra Lee, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 117 days.

(21) Appl. No.: 13/533,177

(22) Filed: Jun. 26, 2012

(65) Prior Publication Data

US 2013/0081586 A1 Apr. 4, 2013

(30) Foreign Application Priority Data

Sep. 30, 2011 (KR) ..... 10-2011-0100040

(51) Int. Cl.
*F01L 9/02* (2006.01)

(52) U.S. Cl.
CPC . *F01L 9/021* (2013.01); *F01L 9/023* (2013.01)
USPC ..... 123/90.12; 123/90.16

(58) Field of Classification Search
CPC ..... F01L 9/021; F01L 9/025; F01L 9/023; F01L 9/02; F01L 1/26; F01L 1/24; F01L 1/267; F01L 13/06; F01M 9/10; F01M 9/105; F01M 9/104
USPC ..... 123/90.33
See application file for complete search history.

(56) References Cited

U.S. PATENT DOCUMENTS

| | | | | |
|---|---|---|---|---|
| 6,701,888 | B2 * | 3/2004 | Houtz | 123/321 |
| 8,079,331 | B2 * | 12/2011 | Vattaneo et al. | 123/90.12 |
| 8,230,830 | B2 * | 7/2012 | Vattaneo | 123/90.12 |
| 8,499,740 | B2 * | 8/2013 | Yoon et al. | 123/321 |
| 2005/0126522 | A1 | 6/2005 | Ruggiero | |
| 2005/0252484 | A1 | 11/2005 | Vanderpoel et al. | |
| 2006/0081213 | A1 | 4/2006 | Yang et al. | |
| 2006/0107914 | A1 | 5/2006 | Dingle et al. | |
| 2009/0308340 | A1 | 12/2009 | Gecim et al. | |
| 2009/0320776 | A1 * | 12/2009 | Vattaneo et al. | 123/90.12 |
| 2010/0326384 | A1 | 12/2010 | Vattaneo | |
| 2012/0048221 | A1 * | 3/2012 | Jeon et al. | 123/90.16 |

FOREIGN PATENT DOCUMENTS

| | | | |
|---|---|---|---|
| EP | 1 375 843 | A1 | 1/2004 |
| KR | 10-2005-0054568 | A | 6/2005 |
| WO | WO 99/23378 | | 5/1999 |

* cited by examiner

*Primary Examiner* — Thomas Denion
*Assistant Examiner* — Daniel Bernstein
(74) *Attorney, Agent, or Firm* — Morgan, Lewis & Bockius LLP

(57) ABSTRACT

A variable valve system, may include a variable valve apparatus that controls opening/closing timing of an exhaust valve and an intake valve of an engine, and an oil supply device that supplies the variable valve apparatus with a pressured oil, wherein the exhaust valve and the intake valve may be opened/closed by rotation of a camshaft, and the oil supply device engaged with the camshaft may be operated by the rotation of the camshaft.

21 Claims, 4 Drawing Sheets

(a)

(b)

(a)

(b)

VARIABLE VALVE SYSTEM

CROSS-REFERENCE TO RELATED APPLICATION

The present application claims priority to Korean Patent Application No. 10-2011-0100040 filed in the Korean Intellectual Property Office on Sep. 30, 2011, the entire contents of which is incorporated herein for all purposes by this reference.

BACKGROUND OF THE INVENTION

1. Field of the Invention

The present invention relates to a variable valve system. More particularly, the present invention relates to a variable valve system having a device that can supply high pressure oil.

2. Description of Related Art

Generally, an automotive engine includes a combustion chamber in which fuel burns to generate power. The combustion chamber is provided with an intake valve for supplying a gas mixture containing the fuel and an exhaust valve for expelling burned gas. The intake and exhaust valves open and close the combustion chamber by a valve lift apparatus connected to a crankshaft. Also, in opening/closing the combustion chamber, a variable valve system is used to effectively control opening/closing timing of the valve. That is, the variable valve system varies valve opening/closing timing depending on the operation conditions of an engine to output appropriate power, to improve intake and exhaust efficiency, and to improve fuel consumption efficiency.

When the movement of the valve is controlled by hydraulic pressure in the variable valve system, if high pressure oil is not stably supplied at the right time, a movement difference of the valves between cylinders can occur. Also, if the pressure of the oil is not maintained at a predetermined level, the valve movement is not accurately controlled. Further, when oil leaks, a temporary operation failure of the variable valve system can be generated.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a variable valve system having advantages of accurately controlling a movement of a valve to be able to supply high pressure oil.

In an aspect of the present invention, a variable valve system may include a variable valve apparatus that controls opening/closing timing of an exhaust valve and an intake valve of an engine, and an oil supply device that supplies the variable valve apparatus with a pressured oil, wherein the exhaust valve and the intake valve are opened/closed by rotation of a camshaft, and the oil supply device engaged with the camshaft is operated by the rotation of the camshaft.

The oil supply device may include an oil compression cylinder that receives oil from a hydraulic pump and uses the oil to generate the pressured oil, a rocker arm that engages the camshaft with the oil compression cylinder such that the oil compression cylinder generates the pressured oil through the rotation of the camshaft, and an oil storage pipe that stores the pressured oil that is received from the oil compression cylinder.

One end of the rocker arm may have a roller and the other end thereof may have a piston press rod.

The roller may have a rotation axis that is parallel to a rotation axis of the camshaft and contacts a cam that is formed on the camshaft to lift/depress the one end of the rocker arm according to the rotation of the camshaft.

When the one end of the rocker arm is moved up/down, the other end thereof is moved up/down with respect to a rocker arm rotation axis of the rocker arm.

A length direction of the piston press rod coincides with an up/down direction of the other end of the rocker arm.

The piston press rod is fixed on the other end of the rocker arm by an engagement means.

The engagement means is a nut and a screw that are formed on the piston press rod.

A socket housing the piston press rod is formed at an upper end of the oil compression cylinder, and a first oil pipe and a second oil pipe fixed to the first oil pipe are formed in the oil compression cylinder.

The first oil pipe is diverged to be connected to the hydraulic pump that is disposed outside the oil compression cylinder, and the second oil pipe is diverged to be connected to the oil storage pipe that is disposed outside the oil compression cylinder.

A first valve is disposed between the first oil pipe and the hydraulic pump.

The first valve is a mono-directional check valve such that the oil moves from the hydraulic pump to the first oil pipe.

The socket, the first oil pipe, and the second oil pipe are sequentially disposed along the length direction of the oil compression cylinder.

An interior diameter of the second oil pipe is smaller than that of the first oil pipe.

A second valve is disposed between the first oil pipe and the second oil pipe.

The second valve is a mono-directional check valve such that the pressured oil moves from the first oil pipe to the second oil pipe.

A piston connected to the piston push rod is slidably disposed in the first oil pipe, and the piston is moved up/down by the up/down movement of the piston press rod.

The oil supply device may have a return means that returns the piston to an original position from a pressed position when the piston press rod moves in a down direction.

The piston press rod and the piston are integrally formed.

The socket and the first oil pipe are integrally formed.

The first oil pipe and the second oil pipe are integrally formed.

The socket, the first oil pipe, and the second oil pipe are integrally formed.

As described above, in an exemplary embodiment of the present invention, an oil supply device is operated by a rocker arm that contacts a camshaft of a variable valve system to be operated, and therefore high pressure oil can be supplied at the correct time.

Also, an oil storage pipe can maintain a predetermined level of oil pressure. Accordingly, the movement of a valve is accurately controlled and a valve movement difference between cylinders can be minimized.

In addition, a hydraulic pump does not need to supply high pressure oil and therefore the size of the hydraulic pump can be reduced. Accordingly, the overall weight of the vehicle can be reduced.

Further, when oil leaks, high pressure oil can be quickly supplied. Therefore, a temporary failure of a variable valve system can be prevented.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
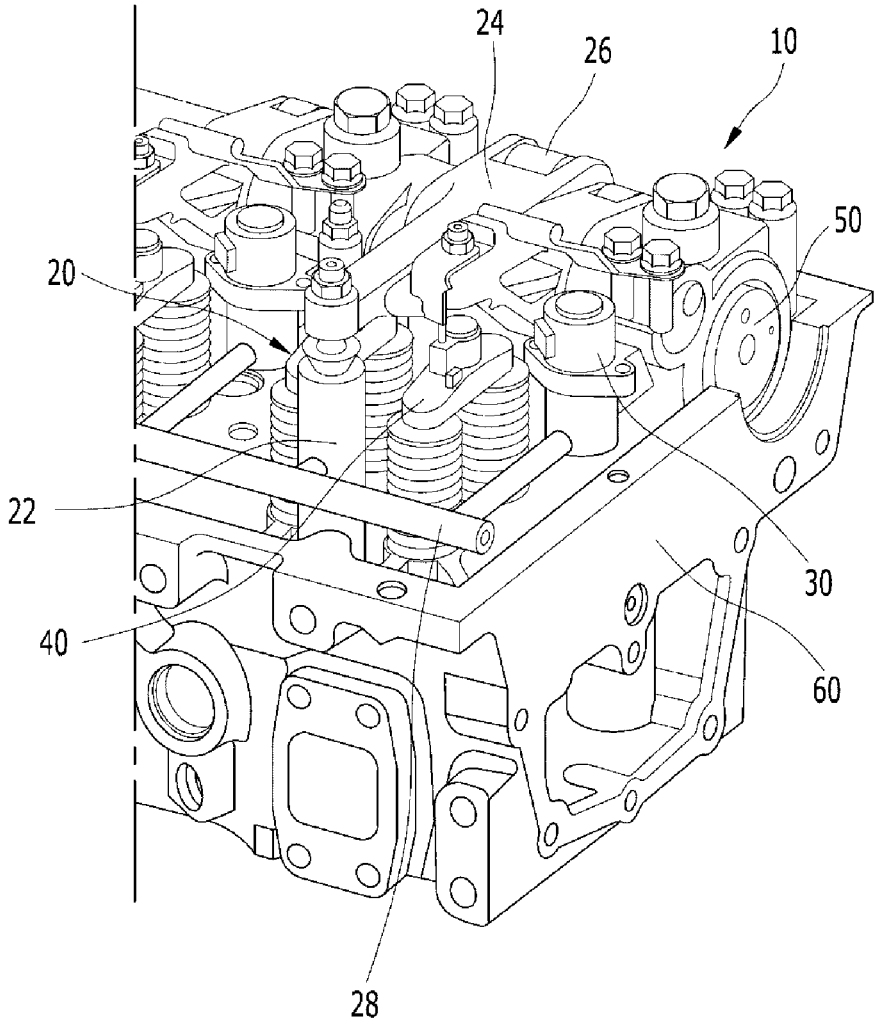
FIG. 1 is a perspective view of an engine cylinder head having a variable valve system according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

FIG. 1 is a perspective view of an engine cylinder head having a variable valve system according to an exemplary embodiment of the present invention.

As shown in FIG. 1, a variable valve system 10 is disposed in an engine compartment 60 and includes a variable valve apparatus 40, a camshaft 50, an oil supply device 20, and a solenoid valve 30.

The variable valve apparatus 40 controls opening/closing timing of an exhaust valve and an intake valve of an engine to be operated by hydraulic pressure.

The camshaft 50 is connected to the exhaust valve and the intake valve through a connecting member. The exhaust valve and the intake valve are opened/closed by the camshaft 50. The structure of the camshaft and the connecting member that close/open the exhaust valve and the intake valve is known to a person of ordinary skill in the art, and therefore a detailed description thereof will be omitted.

The oil supply device 20 supplies the variable valve apparatus 40 with high pressure oil. Also, the oil supply device 20 is operated by the rotation of the camshaft 50.

The solenoid valve 30 is disposed between the variable valve apparatus 40 and the oil supply device 20 to selectively open/close a high pressure oil passage that connects the oil supply device 20 with the variable valve apparatus 40.

Hereinafter, with reference to FIG. 2 and FIG. 3, formation and operation of the oil supply device 20 will be described.

Figure 2:
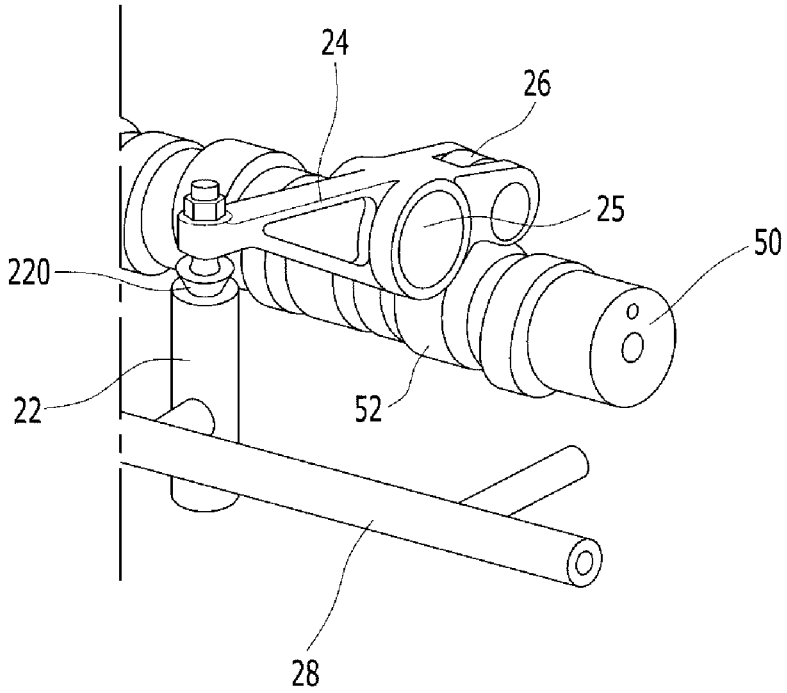
FIG. 2 is a perspective view of an oil supply device according to an exemplary embodiment of the present invention.

FIG. 2 is a perspective view of an oil supply device according to an exemplary embodiment of the present invention.

As shown in FIG. 2, the oil supply device 20 includes an oil compression cylinder 22, a rocker arm 24, and an oil storage pipe 28.

The oil compression cylinder 22 transforms oil that is received from the hydraulic pump 70 to high pressure oil.

The rocker arm 24 connects the camshaft 50 with the oil compression cylinder 22 such that high pressure oil is formed by the rotation of the camshaft 50 in the oil compression cylinder 22. Also, the rocker arm 24 includes two ends, a roller 26 is rotatably disposed at one end of the rocker arm 24, and a piston press rod 210 is fixed on the other end of the rocker arm 24 by an engagement means 212. Further, the rocker arm 24 is rotatably connected to a rocker arm rotation axis 25. Here, the rocker arm rotation axis 25 and the rotation axis of the roller 26 are parallel.

The rotation axis of roller 26 is parallel to the rotation axis of the camshaft 50. A cam 52 is formed to the camshaft 50, and the roller 26 is disposed to contact the cam 52 of the camshaft 50. Further, the cam 52 can have an oval shape in which one part of a circle protrudes. Accordingly, the roller 26 is moved along a profile of the cam 52 by the rotation of the camshaft 50 and the rocker arm 24 is moved based on the rocker arm rotation axis 25. Accordingly, the other end of the rocker arm 24 is moved up/down. In this process, the roller 26 is rotatably disposed, and therefore the movement of the rocker arm 24 is smoothly rotated.

The length direction of the piston press rod 210 is disposed to be almost parallel to the up/down movement direction of the other end of the rocker arm 24. As described above, the piston press rod 210 is fixed on the other end of the rocker arm 24 by the engagement means 212. Here, the engagement means 212 is a nut and a screw that can be formed at an upper end portion of the piston press rod 210 such that the screw is engaged with the nut. Accordingly, the piston press rod 210 is engaged with the rocker arm 24 by the engagement of the engagement means 212 with the piston press rod 210. The engagement means 212 is not limited to a nut and a screw, and a method for engaging the piston press rod 210 with the rocker arm 24 can be variously changed by a person of ordinary skill in the art.

The oil storage pipe 28 stores high pressure oil that is supplied from the oil compression cylinder 22. Also, the oil storage pipe 28 is connected to the solenoid valve 30 to transfer the high pressure oil that is transferred from the oil compression cylinder 22 to the solenoid valve 30. As described above, the solenoid valve 30 selectively supplies the variable valve apparatus 40 with the high pressure oil.

Figure 3:
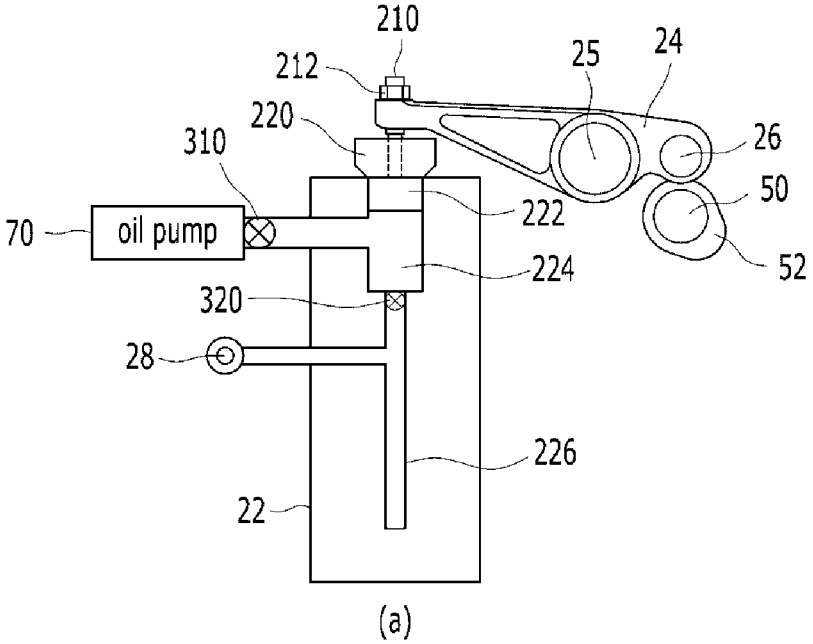
FIGS. 3 (*a*) and (*b*) are schematic diagrams of an oil supply device that is operated by the rotation of a camshaft according to an exemplary embodiment of the present invention.
Figure 3:
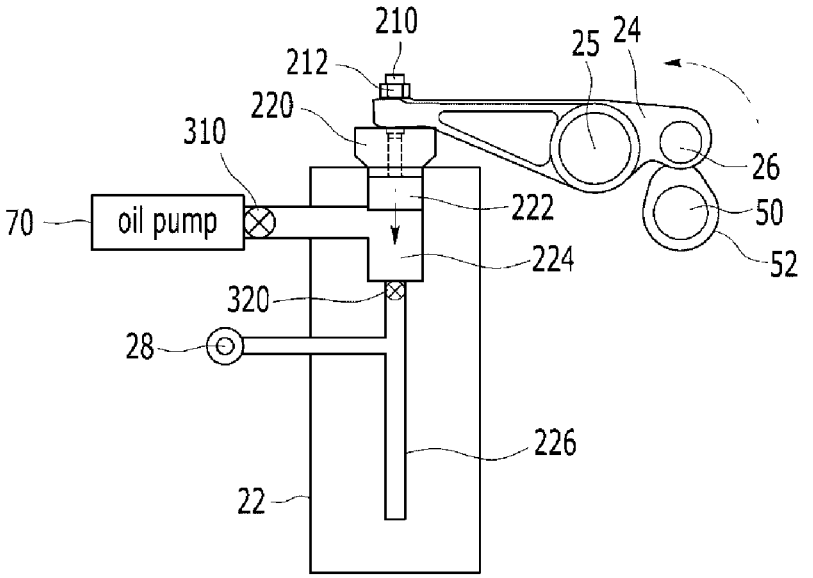

FIGS. 3 (*a*) and (*b*) are schematic diagrams of an oil supply device that is operated by the rotation of a camshaft according to an exemplary embodiment of the present invention. Also, (*a*) of FIG. 3 shows the cam 52 not lifting one end of the rocker arm 24, and (*b*) FIG. 3 shows that cam 52 lifting one end of the rocker arm 24.

As shown in (*a*) and (*b*) of FIG. 3, a socket 220 is disposed at an upper end of the oil compression cylinder 22 to house the piston press rod 210, and a first oil pipe 224 and a second oil pipe 226 are formed inside the oil compression cylinder 22. The socket 220, the first oil pipe 224, and the second oil pipe 226 are sequentially connected along the length direction of the oil compression cylinder 22. Further, the interior diameter of the second oil pipe 226 is smaller than that of the first oil pipe 224.

The socket 220 has a cup shape in which the lower side thereof is opened to house the piston press rod 210. The socket 220 can be integrally formed with the first oil pipe 224. Further, the first oil pipe 224 and the second oil pipe 226 can be integrally formed. That is, the socket 220, the first oil pipe 224, and the second oil pipe 226 can be integrally formed or each can be formed separately.

A piston 222 that can perform a reciprocal motion along the length direction of the first oil pipe 224 can be disposed in the first oil pipe 224. Also, the piston 222 can subordinately perform a reciprocal motion according to up/down movement of the piston press rod 210 that is disposed in the socket 220. Further, the piston 222 and piston press rod 210 can be integrally formed.

The first oil pipe 224 is diverged inside the oil compression cylinder 22 to be connected to a hydraulic pump 70 that is disposed outside the oil compression cylinder 22. Accordingly, the oil compression cylinder 22 receives oil from the hydraulic pump 70. A first valve 310 is disposed between the diverged first oil pipe 224 and the hydraulic pump 70. The first valve 310 can be a mono-directional check valve such that oil is supplied from the hydraulic pump 70 to the first oil pipe 224.

As shown in (*a*) of FIG. 3, if the cam 52 does not lift one end of the rocker arm 24, the piston press rod 210 does not press the piston 222 downward. Accordingly, oil of the first oil pipe 224 that is received from the hydraulic pump 70 is not compressed by the piston 222.

As shown in (*b*) of FIG. 3, if the cam 52 lifts one end of the rocker arm 24, the rocker arm 24 is rotated based on the rocker arm rotation axis 25. In this process, the other end of the rocker arm 24 is moved downward. That is, the piston press rod 210 that is disposed at the other end of the rocker arm 24 presses the piston 222 downward. Accordingly, the piston 222 compresses the oil inside the first oil pipe 224 to supply the second oil pipe 226 with the compressed oil.

As described above, because the interior diameter of the second oil pipe 226 is shorter than that of the first oil pipe 224, the pressure of the oil is increased while the oil flows into the second oil pipe 226. A second valve 320 is disposed between the first oil pipe 224 and the second oil pipe 226. The second valve 320 can be a mono-directional check valve such that the oil flows from the first oil pipe 224 to the second oil pipe 226.

Meanwhile, the cam 52 lifts one end of the rocker arm 24 and then causes one end of the rocker arm 24 to descend through the rotation of the camshaft 50, and the rocker arm 24 rotates clockwise or anticlockwise based on the rocker arm rotation axis 25. A return means can be disposed inside or outside the first oil pipe 224 so as to return the rocker arm 24.

The second oil pipe 226 is diverged inside the oil compression cylinder 22 to be connected to the oil storage pipe 28 that is disposed in the oil compression cylinder 22. Accordingly, the high pressure oil is transferred from the oil compression cylinder 22 to the oil storage pipe 28.

The high pressure oil that is transferred to the oil storage pipe 28 is stored in the oil storage pipe 28 to be supplied to the variable valve apparatus 40 by selectively opening the solenoid valve 30.

Figure 4:
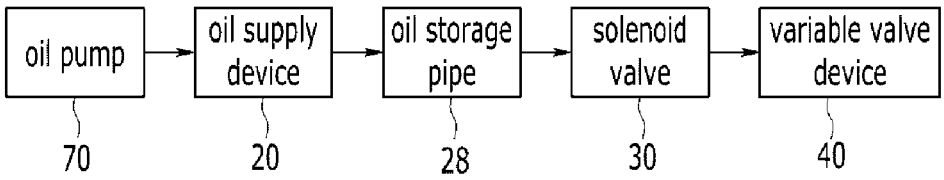
FIG. 4 is a block diagram showing a connection relationship of constituent elements and an oil supply route according to an exemplary embodiment of the present invention.

FIG. 4 is a block diagram showing a connection relationship of constituent elements and an oil supply route according to an exemplary embodiment of the present invention.

As shown in FIG. 4, in a variable valve system according to an exemplary embodiment of the present invention, oil sequentially circulates through the hydraulic pump 70, the oil supply device 20, the oil storage pipe 28, the solenoid valve 30, and the variable valve apparatus 40.

The oil supply route and the relationship of the constituent elements are described with reference to FIG. 1, FIG. 2, and FIG. 3, and the oil supply route is shown in FIG. 4 so as to offer better understanding of the variable valve system 10 having the oil supply device 20 that generates high pressure oil to efficiently operate the variable valve apparatus 40.

As described above, because the operation of the intake valve and exhaust valve of the engine and the operation of the oil supply device 20 are performed by one camshaft 50 in an exemplary embodiment of the present invention, high pressure oil can be supplied at the correct time. Also, the pressure of the oil can be maintained higher than a predetermined value by the oil storage pipe 28. Accordingly, the movement of the valve is accurately controlled and the movement difference between cylinders can be minimized. Further, even if oil leaks, high pressure oil is instantly supplied to the variable valve apparatus 40, and therefore the operation failure of the variable valve system can be prevented. Also, the hydraulic pump 70 does not need to generate high pressure oil and therefore the capacity of the hydraulic pump 70 can be reduced. Accordingly, the overall weight of the vehicle can be reduced.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable valve system, comprising:

a variable valve apparatus that controls opening/closing timing of an exhaust valve and an intake valve of an engine; and an oil supply device that supplies the variable valve apparatus with a pressured oil, wherein the exhaust valve and the intake valve are opened/closed by rotation of a camshaft, and the oil supply device engaged with the camshaft is operated by the rotation of the camshaft;

wherein the oil supply device includes:

a piston press rod having a piston;

a rocker arm, a first end of which is engaged with the camshaft and a second end of which is coupled to the piston press rod;

a first oil pipe wherein the piston of the piston press rod is slidably disposed in the first oil pipe and wherein the first oil pipe is connected to a hydraulic pump to receive oil from the hydraulic pump;

a second oil pipe which is fluid-connected to an end of the first oil pipe;

an oil compression cylinder fluid-connected to the second oil pipe and receiving the pressured oil generated through the rotation of the camshaft and including the first oil pipe therein, wherein the oil compression cylinder mono-directionally receives oil from the hydraulic pump directly through the second oil pipe connected to the first oil pipe, and an oil storage pipe directly branched from the second oil pipe and configured to store the pressured oil that is mono-directionally received directly from the first oil pipe.

2. The variable valve system of claim 1, wherein the first end of the rocker arm has a roller.

3. The variable valve system of claim 2, wherein the roller has a rotation axis that is parallel to a rotation axis of the camshaft and contacts a cam that is formed on the camshaft to lift/depress the first end of the rocker arm according to the rotation of the camshaft.

4. The variable valve system of claim 3, wherein when the first end of the rocker arm is moved up/down, the second end thereof is moved up/down with respect to a rocker arm rotation axis of the rocker arm.

5. The variable valve system of claim 4, wherein a length direction of the piston press rod coincides with an up/down direction of the second end of the rocker arm.

6. The variable valve system of claim 5, wherein the piston press rod is fixed on the second end of the rocker arm by an engagement means.

7. The variable valve system of claim 6, wherein the engagement means is a nut and a screw that are formed on the piston press rod.

8. The variable valve system of claim 2, wherein a socket housing is formed at an upper end of the oil compression cylinder to house the piston press rod.

9. The variable valve system of claim 8, wherein the first oil pipe is diverged to be connected to the hydraulic pump that is disposed outside the oil compression cylinder, and the second oil pipe is diverged to be connected to the oil storage pipe that is disposed outside the oil compression cylinder.

10. The variable valve system of claim 9, wherein a first valve is disposed between the first oil pipe and the hydraulic pump.

11. The variable valve system of claim 10, wherein the first valve is a mono-directional check valve such that the oil moves from the hydraulic pump to the first oil pipe.

12. The variable valve system of claim 8, wherein the socket, the first oil pipe, and the second oil pipe are sequentially disposed along the length direction of the oil compression cylinder.

13. The variable valve system of claim 12, wherein an interior diameter of the second oil pipe is smaller than that of the first oil pipe.

14. The variable valve system of claim 13, wherein a second valve is disposed between the first oil pipe and the second oil pipe.

15. The variable valve system of claim 14, wherein the second valve is a mono-directional check valve such that the pressured oil moves from the first oil pipe to the second oil pipe.

16. The variable valve system of claim 8, wherein the piston is moved up/down by the up/down movement of the piston press rod.

17. The variable valve system of claim 16, wherein the oil supply device has a return means that returns the piston to an original position from a pressed position when the piston press rod moves in a down direction.

18. The variable valve system of claim 16, wherein the piston press rod and the piston are integrally formed.

19. The variable valve system of claim 8, wherein the socket and the first oil pipe are integrally formed.

20. The variable valve system of claim 8, wherein the first oil pipe and the second oil pipe are integrally formed.

21. The variable valve system of claim 8, wherein the socket, the first oil pipe, and the second oil pipe are integrally formed.

* * * * *